US005755207A

United States Patent [19]

Kushibe

[11] Patent Number: 5,755,207

[45] Date of Patent: May 26, 1998

[54] FUEL INJECTION CONTROL DEVICE FOR A SPARK IGNITION ENGINE WITH A FUEL INJECTOR FOR INJECTING FUEL DIRECTLY INTO THE CYLINDER

[75] Inventor: Takahiro Kushibe, Susono, Japan

[73] Assignee: Toyota Jidosha Kabushiki Kaisha, Aichi, Japan

[21] Appl. No.: 782,054

[22] Filed: Jan. 13, 1997

[30] Foreign Application Priority Data

Jan. 16, 1996 [JP] Japan ..... 8-004886

[51] Int. Cl.[6] ..... F02D 41/00

[52] U.S. Cl. ..... 123/478; 123/294

[58] Field of Search ..... 123/478, 480, 123/496, 497, 456, 294, 491

[56] References Cited

U.S. PATENT DOCUMENTS 5,474,054 12/1995 Povinger et al. ..... 123/689

FOREIGN PATENT DOCUMENTS

U-59-84274 6/1984 Japan .

A-7-166927 6/1995 Japan .

*Primary Examiner*—Willis R. Wolfe

*Assistant Examiner*—Hieu T. Vo

*Attorney, Agent, or Firm*—Oliff & Berridge, PLC

[57] ABSTRACT

A fuel injection control device for a spark ignition engine with a fuel injector for injecting fuel directly into the cylinder is disclosed. The device comprises a determination mechanism for determining that the temperature of the injection hole of the injector is higher than a predetermined temperature. A controller controls the fuel injection such that a required amount of fuel is injected after the fuel pressure is dropped when the determination mechanism determines that the temperature of the injection hole of the injector is higher than the predetermined temperature.

11 Claims, 8 Drawing Sheets

FUEL INJECTION CONTROL DEVICE FOR A SPARK IGNITION ENGINE WITH A FUEL INJECTOR FOR INJECTING FUEL DIRECTLY INTO THE CYLINDER

BACKGROUND OF THE INVENTION

1. Field of the Invention

The present invention relates to a fuel injection control device for a spark ignition engine with a fuel injector for injecting fuel directly into the cylinder.

2. Description of the Related Art

A spark ignition engine in which fuel is injected directly into a cylinder is known. In a fuel injector used in such an engine, the injection hole thereof is always exposed in the combustion chamber of the engine so that a deposit can easily accumulate in the injection hole. The injection properties of the injector can be varied by the deposit, and thus the deposit prevents a desired amount of fuel being injected by the injector.

Japanese Unexamined Utility Model Publication No. 59-84274 discloses that the injection hole of an injector is coated with fluorocarbon resin so that the deposit hardly accumulates therein.

However, the life of the fluorocarbon resin coating is not long. Accordingly, an invention which can reduce the amount of deposit is desired.

SUMMARY OF THE INVENTION

Therefore, an object of the present invention is to provide a fuel injection control device for a spark ignition engine with a fuel injector for injecting fuel directly into the cylinder, which can prevent the deposit accumulating in the injection hole of the injector.

According to the present invention there is provided a fuel injection control device for a spark ignition engine with a fuel injector for injecting fuel directly into the cylinder comprising: determination means for determining that the temperature of the injection hole of the injector is higher than a predetermined temperature; and control means for controlling the fuel injection such that a required amount of fuel is injected after the fuel pressure is dropped when the determination means determines that the temperature of the injection hole of the injector is higher than the predetermined temperature.

The present invention will be more fully understood from the description of the preferred embodiments of the invention set forth below, together with the accompanying drawings.

DESCRIPTION OF THE PREFERRED EMBODIMENTS

Figure 1:
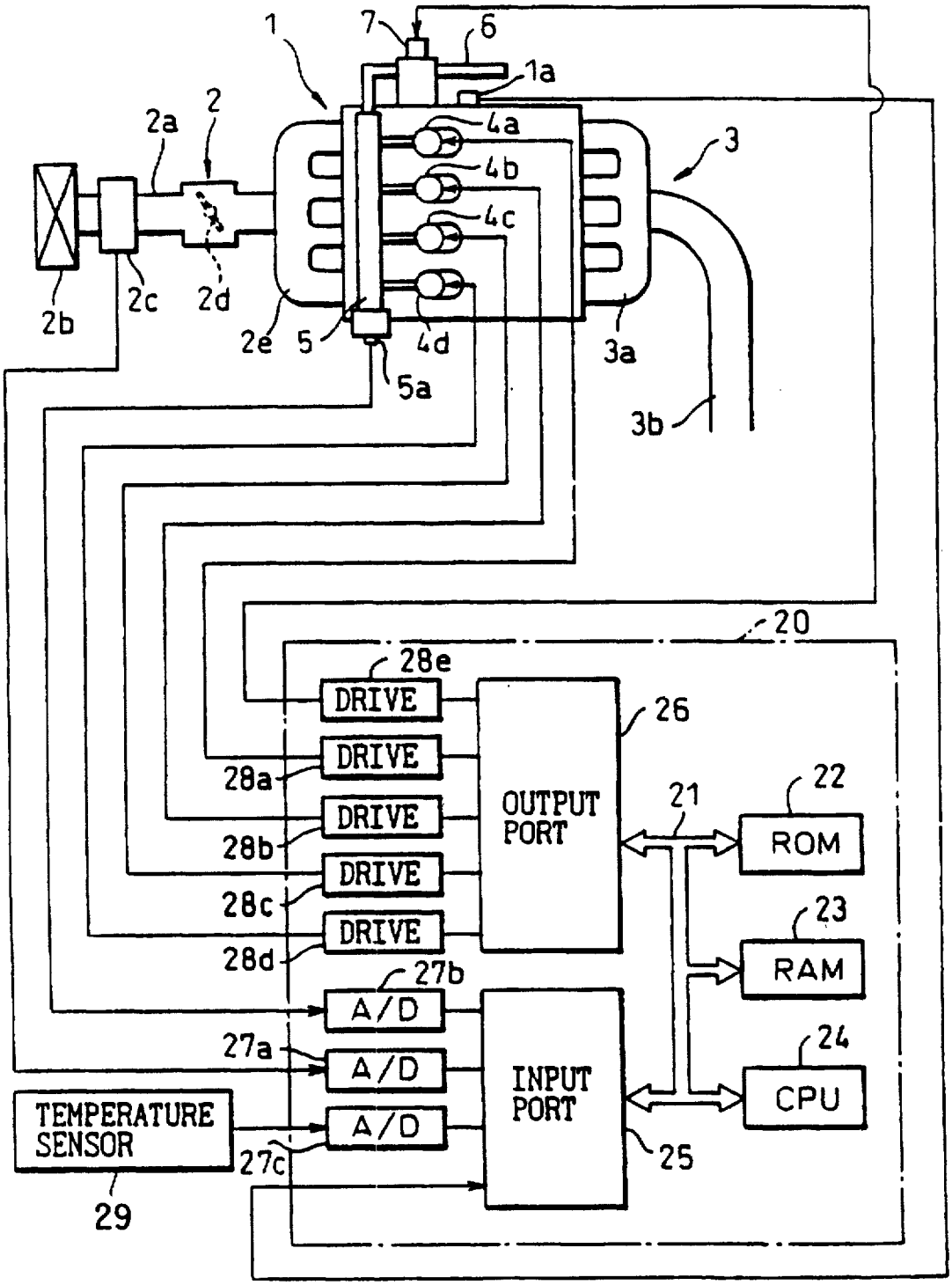
FIG. 1 is a schematic view of a spark ignition engine with a fuel injector for injecting fuel directly into the cylinder, having a fuel injection control device according to the present invention.

FIG. 1 is a schematic view of a spark ignition engine with a fuel injector for injecting fuel directly into the cylinder, having a fuel injection control device according to the present invention. In this figure, reference numeral 1 designates the engine. The engine is, for example, an four-cylinder engine. Reference numeral 2 designates an intake system of the engine 1. Reference numeral 3 designates an exhaust system of the engine 1. The intake system 2 has a single intake pipe 2*a*. An air cleaner 2*b* is arranged at the upstream end of the intake pipe 2*a*. An air-flow meter 2*c* is arranged immediate downstream of the air cleaner 2*b* in the intake pipe 2*a*. A throttle valve 2*d* is arranged downstream of the air-flow meter 2*c* in the intake pipe 2*a*. The intake pipe 2*a* is connected with each cylinder via an intake manifold 2*e*. The exhaust system 3 is connected with each cylinder via an exhaust manifold 3*a*. A single exhaust pipe 3*b* is arranged downstream of the exhaust manifold 3*a*.

A fuel injector 4*a* to 4*d* for each cylinder is arranged in the engine 1, which fuel injector injects fuel directly into the cylinder. In each fuel injector 4*a* to 4*d*, fuel is distributed from a common distribution pipe 5. The distribution pipe 5 is connected with a fuel tank (not shown) via a fuel supply pipe 6. A low pressure pump and the like (not shown) is arranged in the fuel supply pipe 6 so that fuel is always supplied to the distribution pipe 5 from the fuel tank, via the fuel supply pipe 6 at a predetermined low pressure (for example, 2 MPa). In the fuel supply pipe 6, a high pressure pump 7 is arranged close to the distribution pipe 5 so that fuel supplied to the distribution pipe 5 can be also pressurized at a predetermined high pressure (for example, 5 MPa).

Reference numeral 20 designates an electronic control unit (ECU) for controlling each fuel injector 4*a* to 4*d* and the high pressure pump 7. The ECU 20 is constructed as a digital computer and includes a ROM (read only memory) 22, a RAM (random access memory) 23, a CPU (microprocessor, etc.) 24, an input port 25, and an output port 26. The ROM 22, the RAM 23, the CPU 24, the input port 25, and the output port 26 are interconnected by a bidirectional bus 21.

The air-flow meter 2*c* detects the amount of intake air and is connected to the input port 25, via an AD converter 27*a*. An engine speed sensor 1*a* detects the engine speed and is connected to the input port 25. A pressure sensor 5*a* detects the pressure of fuel in the distribution pipe 5 and is connected to the input port 25, via an AD converter 27b. The output port 26 is connected to each fuel injector 4a to 4d via each drive circuit 28a to 28d, and is connected to the high pressure pump 7 via a drive circuit 28e.

Figure 2:
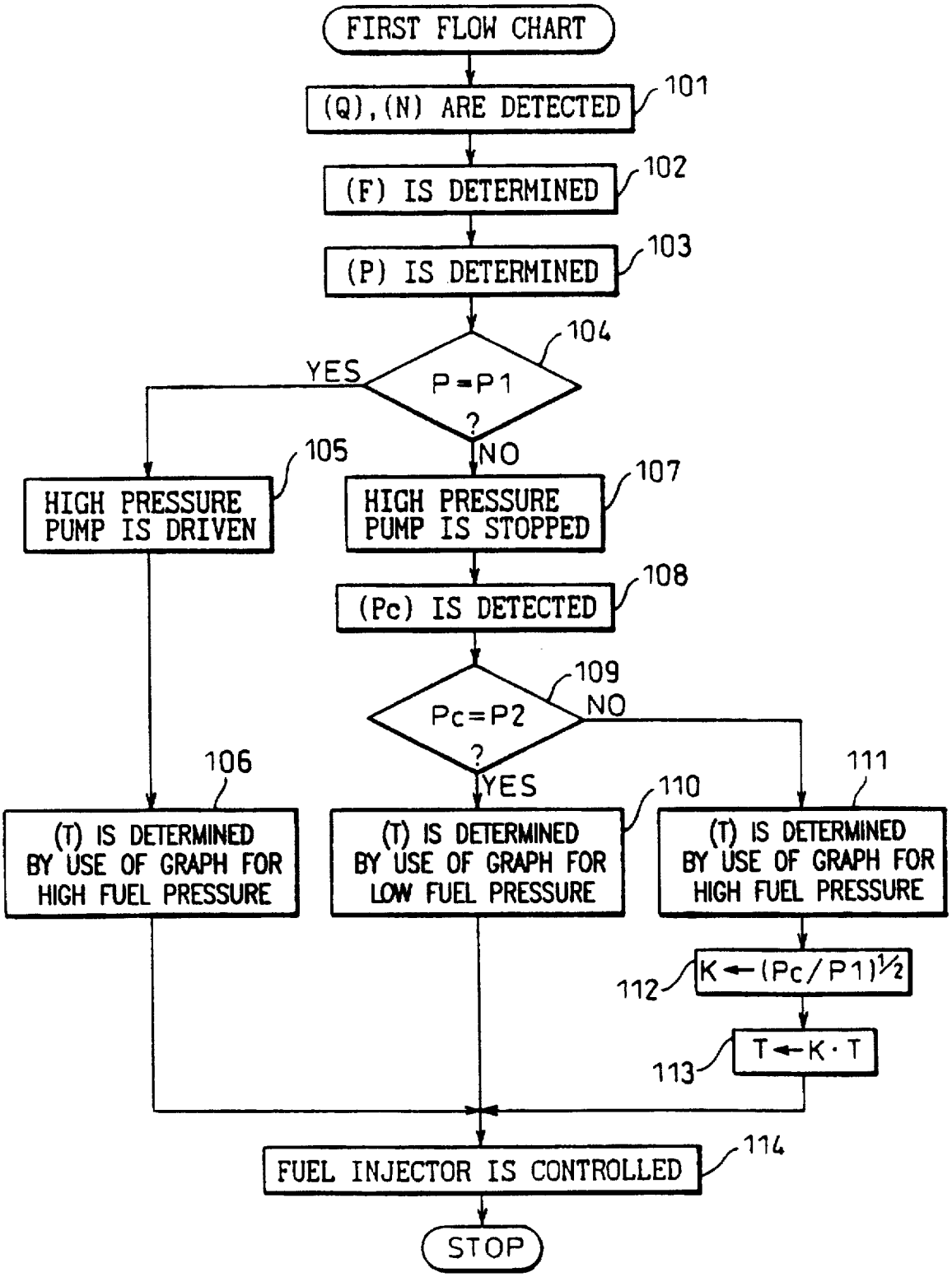
FIG. 2 is a first flow chart for controlling each fuel injector and the high pressure pump.
Figure 3:
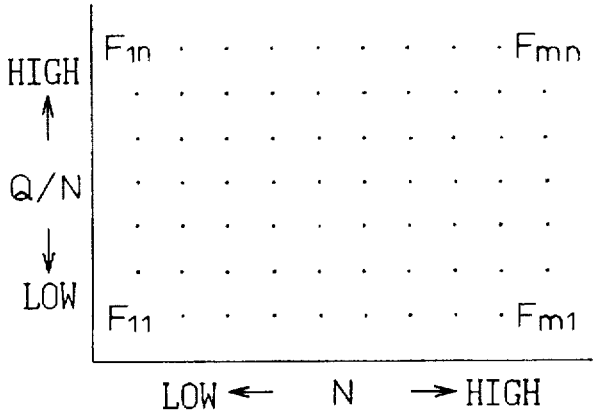
FIG. 3 is a first graph for determining a required amount of fuel on the basis of the current engine operating condition.

The ECU 20 controls each fuel injector 4a to 4d and the high pressure pump 7, according to a first flow chart shown in FIG. 2. The first flow chart is carried out every predetermined period, for example, every time a specific fuel injector injects fuel. First, at step 101, the current amount of intake air (Q) and the current engine speed (N) are detected by the air-flow meter 2c and the engine speed sensor 1a. Next, at step 102, a required amount of fuel (F) for the current engine operating condition is determined from a first graph shown in FIG. 3, on the basis of the current engine speed (N) and the current amount of intake air per one revolution (Q/N) as the current engine load. In the first map, a required amount of fuel is set such that the higher the engine load and engine speed become, the more a required amount of fuel (F) becomes.

Figure 4:
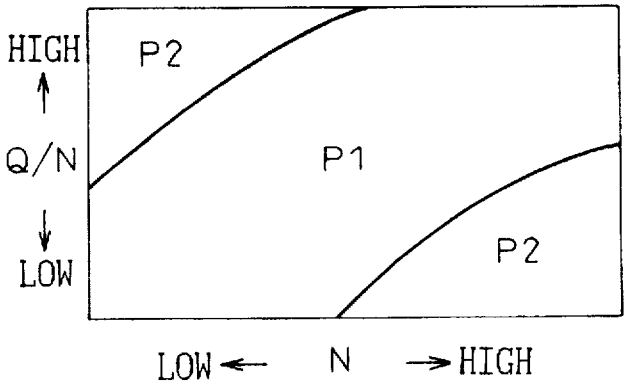
FIG. 4 is a second graph for determining an optimum fuel pressure on the basis of the current engine operating condition.

Next, at step 103, an optimum fuel pressure (P) for the current engine operating condition is determined from a second graph shown in FIG. 4, on the basis of the current engine speed (N) and the current engine load (Q/N). In the second graph, the low fuel pressure (P2) is set in the high engine load and low engine speed operating conditions and in the low engine load and high engine speed operating conditions, and the high fuel pressure (P1) is set in the other engine operating conditions. Next, at step 104, it is determined if the optimum fuel pressure (P) determined at step 103 is the high fuel pressure (P1). When the result is positive, the routine goes to step 105 and the high pressure pump 7 is driven.

Figure 5A:
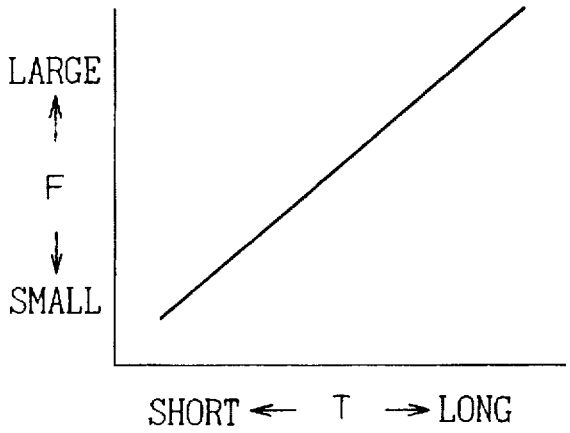
FIG. 5(A) is a graph for determining an injector open period of each fuel injector at the high fuel pressure.

Next, at step 106, an injector open period (T) of each fuel injector 4a to 4d is determined from a graph for the high fuel pressure shown in FIG. 5(A), on the basis of the required amount of fuel (F) determined at step 102 and at step 114, each fuel injector 4a to 4d is controlled such that the injector open period (T) is realized in the desired fuel injection timing.

On the other hand, when the result at step 104 is negative, i.e., when the fuel pressure (P) determined at step 103 is the low fuel pressure (P2), the routine goes to step 107 and the high pressure pump 7 is stopped. Next, at step 108, the current fuel pressure (Pc) in the distribution pipe 5 is detected by the pressure sensor 5a and at step 109, it is determined if the fuel pressure (Pc) is nearly equal to the low fuel pressure (P2).

Figure 5B:
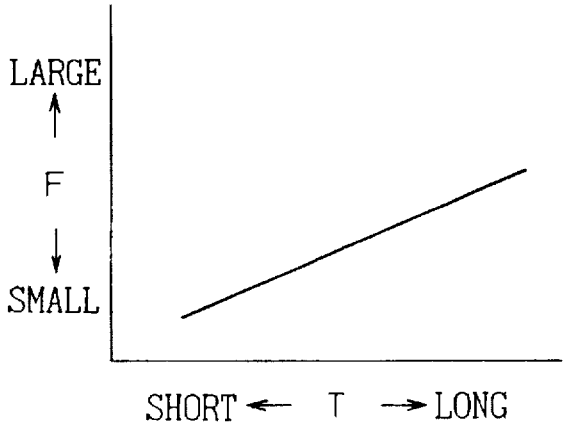
FIG. 5(B) is a graph for determining an injector open period of each fuel injector at the low fuel pressure.

When the result at step 109 is positive, the routine goes to step 110 and an injector open period (T) of each fuel injector 4a to 4d is determined from a graph for the low fuel pressure shown in FIG. 5(B), on the basis of the required amount of fuel (F) determined at step 102 and at step 114, each fuel injector 4a to 4d is controlled such that the injector open period (T) is realized in the desired fuel injection timing.

The graph for the low fuel pressure has a small inclination, as an amount of fuel injected per unit period at the low fuel pressure. The above-mentioned graph for the high fuel pressure has a large inclination, as an amount of fuel injected per unit period at the high fuel pressure. Therefore, an injector open period for injecting a given amount of fuel at the low fuel pressure is longer than an injector open period for injecting the same amount of fuel at the high fuel pressure.

In the injection hole of the fuel injector, fuel is easily carbonized when a temperature of the injection hole is higher than a first given temperature (approximately 150 degrees C. in case of gasoline). The carbonized fuel becomes a deposit. When the temperature of the injection hole becomes higher than a second given temperature, the produced deposit burns. Therefore, when a temperature of the injection hole is between the first and second given temperatures, the deposit accumulates therein. Accordingly, if a temperature of the injection hole is made lower than the first given temperature or higher than the second given temperature, the accumulation of deposit in the injection hole can be prevented. However, if a temperature of the injection hole is kept higher than the second given temperature, not only is a heater for heating the injection hole required, but also fuel vaporizes easily in the fuel injection system. Accordingly, the present embodiment intends that a temperature of the injection hole is kept lower than the first given temperature.

The temperature of the injection hole depends on the engine operating condition. In the high engine load, the required amount of fuel is relatively large so that the injection period becomes relative long and the combustion energy at one time becomes large. In such a high engine load, if the engine speed is high, the combustion period becomes short although the combustion energy is large. Therefore, the injection hole is sufficiently cooled by the lengthy fuel injection so that the temperature of the injection hole is kept lower than the first given temperature. However, if the engine speed is low, the combustion period becomes long so that the cooling by the fuel injection becomes insufficient and thus, in the prior art, the temperature of the injection hole becomes higher than the first given temperature. In such high engine load and low engine speed operating conditions, the fuel pressure (P) is made the low fuel pressure (P2) by the present embodiment as the above-mentioned so that the injection period becomes longer, and thus an ability of cooling by the fuel injection increases. Therefore, the temperature of the injection hole can be kept lower than the first given temperature.

On the other hand, in the low engine load, the required amount of fuel is relative small so that the injection period becomes relative short and an ability of cooling by the fuel injection is low. In such a low engine load, if the engine speed is high, the combustion times per unit period increases so that the injection hole can not be sufficiently cooled due to the low ability of cooling by the fuel injection. Therefore, in the prior art, the temperature of the injection hole becomes higher than the first given temperature. In such low engine load and high engine speed operating conditions, the fuel pressure (P) is made the low fuel pressure (P2) by the present embodiment as the above-mentioned so that the injection period becomes long, and thus an ability of cooling by the fuel injection increases. Therefore, the temperature of the injection hole can be kept lower than the first given temperature. On the other hand, in low engine load and low engine speed operating conditions, the combustion energy is small. Accordingly, if the combustion period becomes long, the combustion does not contribute largely a rise of the temperature of the injection hole. Moreover, the combustion times per unit period also decreases. At this time, if the fuel pressure (P) is not made the low fuel pressure (P2), the temperature of the injection hole is kept lower than the first given temperature.

In the spark ignition engine with the fuel injector for injecting fuel directly into the cylinder, the fuel pressure is usually made high and the injection period is made short so that a long period from the end of the fuel injection to the ignition is obtained and thus the injected fuel can vaporizes sufficiently before the ignition. Accordingly, in the present invention, if the fuel pressure is made the low fuel pressure (P2) in the above-mentioned specific engine operating conditions, it is possible that the vaporization of fuel will deteriorate at this time. However, when the fuel pressure is made the low fuel pressure (P2), it is necessary to increase an ability of cooling by the fuel injection so that the temperature of the fuel used in the cooling becomes higher than that when the fuel pressure is not made the low fuel pressure (P2). Therefore, the fuel vaporizes easily and thus if a period from the end of the fuel injection to the ignition become short, the vaporization of the fuel does not deteriorate.

In the present embodiment, one of the high fuel pressure (P1) and the low fuel pressure (P2) is selected as the fuel pressure, according to the current engine operating condition. The volume of the distribution pipe 5 is not large. Accordingly, when the fuel pressure in the distribution pipe 5 is changed from the low fuel pressure (P2) to the high fuel pressure (P1), the fuel pressure therein can rise from the low fuel pressure (P2) to the high fuel pressure (P1) as soon as the high pressure pump 7 is driven. However, to drop the fuel pressure therein from the high fuel pressure (P1) to the low fuel pressure (P2), a predetermined amount of fuel in the distribution pipe 5 must be consumed by the fuel injection after the high pressure pump 7 is stopped.

Accordingly, at step 107 of the first flow chart, immediate after the high pressure pump 7 is stopped, the fuel pressure (Pc) in the distribution pipe 5 does not drop to the low fuel pressure (P2) and thus the result at step 109 is negative and the routine goes to step 111. At step 111, an injector open period (T) of each fuel injector 4*a* to 4*d* is determined from a graph for the high fuel pressure shown in FIG. 5(A), on the basis of the required amount of fuel (F) determined at step 102. Next, the routine goes to step 112. The amount of fuel injected per an unit period in the fuel injector is proportional to the square root of the fuel pressure. Therefore, at step 112, a correction coefficient (K) of the injector open period (T) according to the current fuel pressure (Pc) is calculated using the following expression.

$$K=(Pc/P1)^{1/2}$$

Next, at step 113, a new injector open period (T) is calculated by multiplying the injector open period (T) calculated at step 111 by the correction coefficient (K). At step 114, each fuel injector 4*a* to 4*d* is controlled such that the injector open period (T) is realized at the desired fuel injection timing. Accordingly, while the fuel pressure is dropped to the low fuel pressure (P2) from the high fuel pressure (P1), the required amount of fuel can be injected.

When the fuel pressure is dropped to the low fuel pressure (P2) from the high fuel pressure (P1), a part of fuel in the distribution pipe 5 may be returned to the fuel tank. In this case, the fuel pressure in the distribution pipe 5 drops to the low fuel pressure (P2) instantaneously so that the process of steps 111 and 112 is unnecessary. However, the pressure of the fuel returned to the fuel tank is high so that the returned fuel can boil under the reduced pressure. If the returned fuel boils, a lot of fuel bubbles are generated and a part of the bubbles can enter into the fuel supply pipe 6 so that the required amount of fuel can not be injected due to the bubbles. Even if the returned fuel does not boil, the temperature of fuel in the fuel tank rises due to the returned fuel so that the fuel can vaporize in the fuel injection system and thus the required amount of fuel can not be injected. According to the present embodiment, the fuel in the distribution pipe 5 does not return to the fuel tank so that the problem in which the required amount of fuel can not be injected does not occur.

Figure 6:
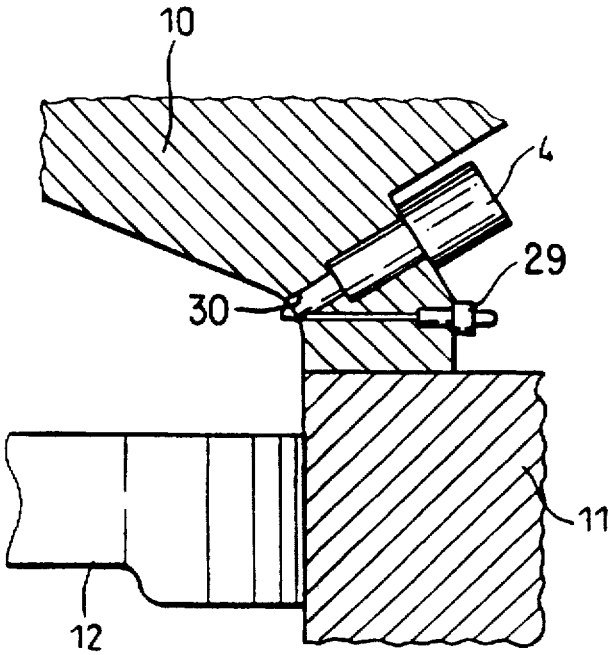
FIG. 6 is a sectional view of the vicinity of the fuel injector for injecting fuel directly into the cylinder in the engine.
Figure 7:
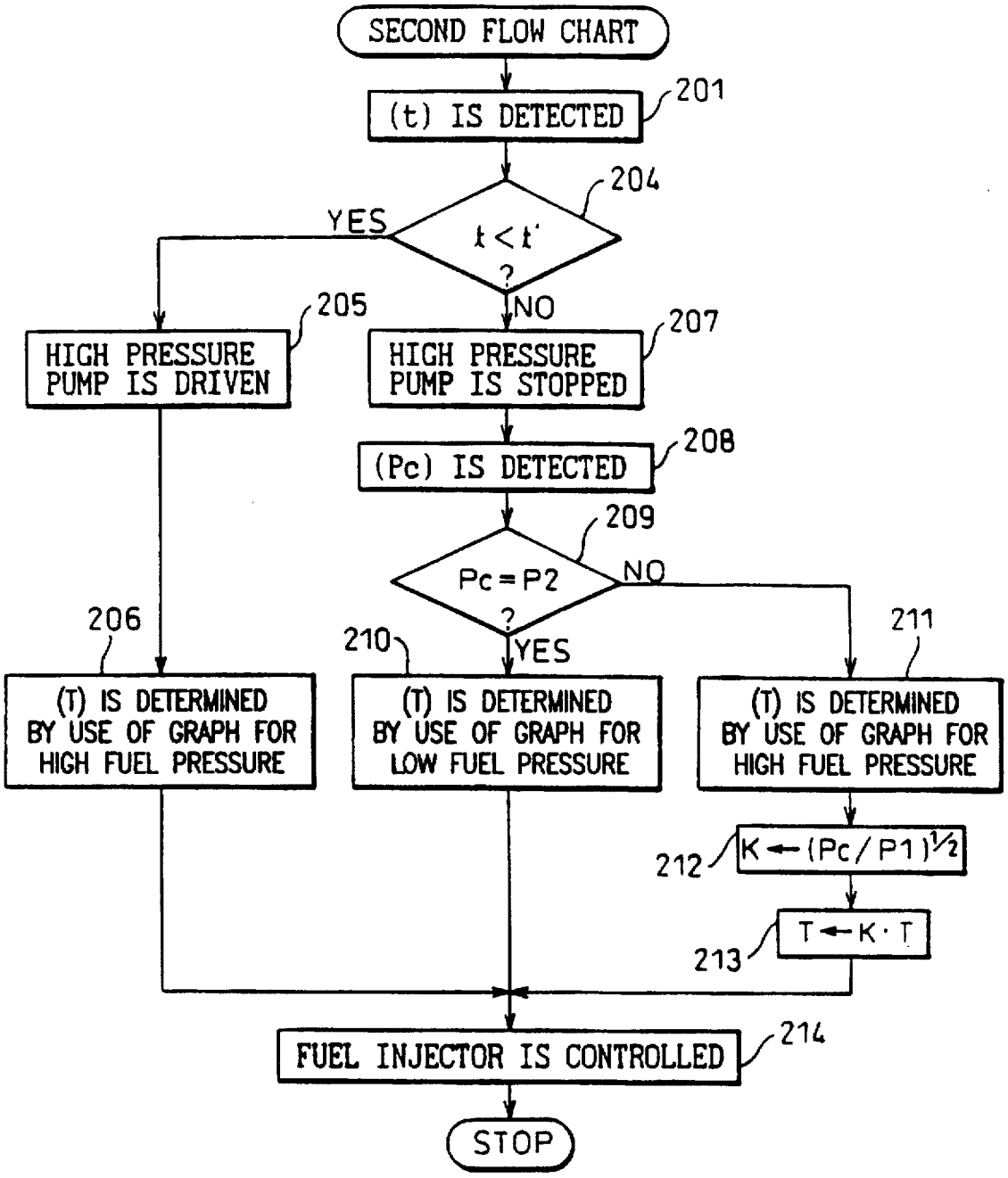
FIG. 7 is a second flow chart for controlling each fuel injector and the high pressure pump.
Figure 8:
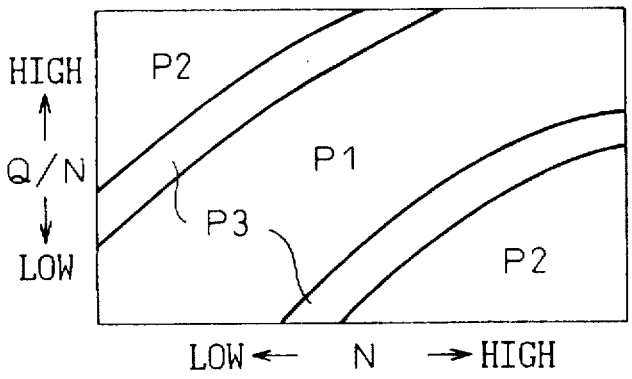
FIG. 8 is a graph for determining an optimum fuel pressure on the basis of the current engine operating condition.
Figure 9:
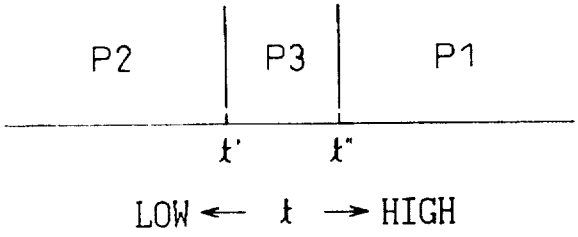
FIG. 9 is a graph for determining an optimum fuel pressure on the basis of the current temperature in the vicinity of the injection hole of the injector.
Figure 10:
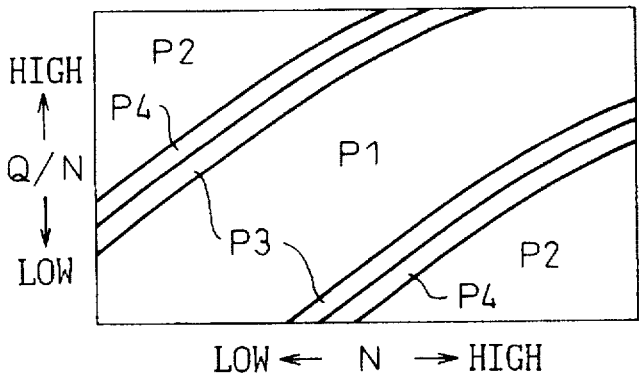
FIG. 10 is another graph for determining an optimum fuel pressure on the basis of the current engine operating condition.
Figure 11:
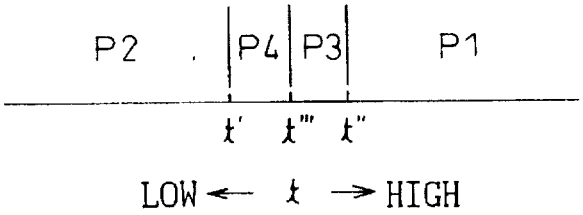
FIG. 11 is another graph for determining an optimum fuel pressure on the basis of the current temperature in the vicinity of the injection hole of the injector.

FIG. 6 is a sectional view of the vicinity of the fuel injector for injecting fuel directly into the cylinder in the engine. In this figure, reference numeral 10 designates the cylinder head. Reference numeral 11 designates the cylinder block. Reference numeral 12 designates the piston. A temperature sensor 29 abuts against the fuel injector 4 in the vicinity of the injection hole 30. The temperature sensor 29 detects directly a temperature in the vicinity of the injection hole and is connected to the input port 25, via an AD converter 27*c* as shown in FIG. 1. In case that the temperature sensor 29 is provided, the ECU 20 controls each fuel injector 4*a* to 4*d* and the high pressure pump 7, according to a second flow chart shown in FIG. 7. The differences between the first and second flow charts are explained as follows.

First, at step 201, the current temperature (t) in the vicinity of the injection hole is detected by the temperature sensor 29. Next, at step 204, it is determined if the current temperature (t) is lower than a predetermined temperature (t'). The predetermined temperature (t') is a temperature detected by the temperature sensor 29 when the temperature of the injection hole is the first given temperature (approximately 150 degrees C.). Accordingly, when the result at step 204 is positive, the temperature of the injection hole is lower than the first given temperature and the routine goes to step 205. Thus, the high pressure pump 7 is driven and the fuel injection at the high fuel pressure is carried out, as the first flow chart.

On the other hand, when the result at step 204 is negative, i.e., when the temperature of the injection hole is higher than the first given temperature, the routine goes to step 207. Thus, the high pressure pump 7 is stopped and the fuel injection at the low fuel pressure is carried out so that the accumulation of deposit in the injection hole can be prevented, as the first flow chart. In the first flow chart, the temperature of the injection hole is estimated according to the current engine operating condition. However, in the second flow chart, the temperature of the injection hole is detected almost directly so that the accumulation of deposit in the injection hole can be prevented more surely than in the first flow chart.

In the above-mentioned two flow charts, to simplify the fuel injection control, the fuel pressure is changed between the high and low pressures. However, it is understood that to utilize the two fuel pressures does not limit the present invention. For example, three or four fuel pressures may be utilized as shown FIGS. 8, 9, 10, and 11. Here, these fuel pressures (P1), (P2), (P3), (P4) have the relationship "P1<P3<P4<P2". Therefore, the fuel pressure is dropped at a minimum so that in the engine operating conditions in which the fuel pressure (P3) or (P4) is selected, the fuel injection period becomes shorter in comparison with a case that the low fuel pressure (P1) is selected in the same engine operating conditions. Thus, the period from the end of the fuel injection to the ignition becomes long and the injected fuel can vaporize very efficiently before ignition.

Although the invention has been described with reference to specific embodiments thereof, it should be apparent that numerous modifications can be made thereto by those skilled in the art, without departing from the basic concept and scope of the invention.

I claim:

1. A fuel injection control device for a spark ignition engine with a fuel injector for injecting fuel directly into a cylinder through an injection hole formed therein comprising:

determination means for determining whether a temperature of the injection hole is higher than a predetermined temperature; and control means for controlling fuel injection such that a required amount of fuel is injected after fuel pressure drops when said determination means determines that the temperature of the injection hole injector is higher than said predetermined temperature.

2. A fuel injection control device according to claim 1, wherein said determination means determines that the temperature of the injection hole is higher than said predetermined temperature when a current engine operating condition is a low engine load and high engine speed operating condition.

3. A fuel injection control device according to claim 1, wherein said determination means determines that the temperature of the injection hole is higher than said predetermined temperature when a current engine operating condition is one of a low engine load and high engine speed operating condition and a high engine load and low engine speed operating condition.

4. A fuel injection control device according to claim 1, wherein said determination means determines that the temperature of the injection hole is higher than said predetermined temperature by measuring temperature in a vicinity of said injection hole.

5. A fuel injection control device according to claim 1, wherein said control means determines an injector open period, for injecting a required amount of fuel, based on a current fuel pressure.

6. A fuel injection control device according to claim 1, wherein said predetermined temperature is approximately 150 degrees C.

7. A fuel injection control assembly, comprising:

a cylinder defining a combustion chamber therein that receives fuel, the cylinder having an injection hole formed therein;

a fuel injector cooperating with the injection hole to inject fuel directly into the combustion chamber;

a temperature sensor coupled to the cylinder adjacent the injection hole to determine a temperature of the injection hole; and a controller coupled to the fuel injector and the temperature sensor that controls fuel injection by the fuel injector based on the temperature of the injection hole sensed by the temperature sensor.

8. The fuel injection control assembly of claim 7, wherein the cylinder comprises a cylinder head and the injection hole is formed as a passage through the cylinder head, and wherein the temperature sensor communicates with the passage through the cylinder head.

9. The fuel injection control assembly of claim 7 wherein the controller determines whether the temperature of the injection hole is higher than a predetermined temperature and controls an amount of fuel required for injection based on the determination of the controller.

10. The fuel injection control assembly of claim 7, wherein the controller controls fuel injection when the sensed temperature of the injection hole is higher than a predetermined temperature such that a required amount of fuel is injected with a lower fuel pressure.

11. The fuel injection control assembly of claim 7 further comprising a fuel pressure pump connected to the fuel injector, wherein the controller controls the fuel injector with the fuel pressure pump based on the sensed temperature of the injection hole.

* * * * *